US011098944B2

(12) United States Patent
Shin et al.

(10) Patent No.: US 11,098,944 B2
(45) Date of Patent: Aug. 24, 2021

(54) EVAPORATOR AND REFRIGERATOR COMPRISING SAME

(71) Applicant: LG Electronics Inc., Seoul (KR)

(72) Inventors: Youngjae Shin, Seoul (KR); Woocheol Kang, Seoul (KR); Geunhyung Lee, Seoul (KR); Gwinan Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 324 days.

(21) Appl. No.: 16/086,753

(22) PCT Filed: Mar. 2, 2017

(86) PCT No.: PCT/KR2017/002269
§ 371 (c)(1),
(2) Date: Sep. 20, 2018

(87) PCT Pub. No.: WO2017/164533
PCT Pub. Date: Sep. 28, 2017

(65) Prior Publication Data

US 2019/0107318 A1 Apr. 11, 2019

(30) Foreign Application Priority Data

Mar. 22, 2016 (KR) ..... 10-2016-0034187

(51) Int. Cl.
*F25D 21/08* (2006.01)
*F25D 19/00* (2006.01)
(Continued)

(52) U.S. Cl.
CPC ..... *F25D 21/08* (2013.01); *F25B 39/022* (2013.01); *F25D 13/04* (2013.01); *F25D 19/00* (2013.01); *F25D 21/06* (2013.01); *H05B 3/48* (2013.01)

(58) Field of Classification Search
CPC ..... F25B 39/02; F25B 39/022; F25D 21/08; F25D 21/06
See application file for complete search history.

(56) References Cited

U.S. PATENT DOCUMENTS 2,777,300 A * 1/1957 Palmer ..... C08G 63/6856 62/276
2,802,346 A 8/1957 Simmons
(Continued)

FOREIGN PATENT DOCUMENTS

JP 1980130187 9/1980
JP 2005300049 10/2005
(Continued)

OTHER PUBLICATIONS

Extended European Search Report in European Application No. 17770504.3, dated Dec. 16, 2019, 8 pages.
(Continued)

*Primary Examiner* — Ana M Vazquez
(74) *Attorney, Agent, or Firm* — Fish & Richardson P.C.

(57) ABSTRACT

A refrigerator includes a cabinet that defines a freezing compartment and a refrigerating compartment, and an evaporator installed in the freezing compartment. The evaporator includes: an evaporator case that defines a food storage space formed therein; a cooling tube located at the evaporator case in a predetermined pattern and configured to receive a coolant; and a sheath heater disposed outside of the evaporator case to be adjacent to at least one surface of the evaporator case, the sheath heater being configured to generate heat such that heat for defrosting is transferred to the evaporator case. The sheath heater reduces the defrosting time to maintain the freshness of food, increases the cooling efficiency, and reduces power consumption. The defrosting efficiency by the sheath heater is improved by a reflection
(Continued)

member, and an inflow of heat, generated when defrosting, into the refrigerating compartment is reduced by a heat insulation member.

16 Claims, 5 Drawing Sheets

(51) Int. Cl.

| | |
|---|---|
| ***H05B 3/48*** | (2006.01) |
| ***F25D 21/06*** | (2006.01) |
| ***F25B 39/02*** | (2006.01) |
| ***F25D 13/04*** | (2006.01) |

(56) References Cited

U.S. PATENT DOCUMENTS

| | | | | | |
|---|---|---|---|---|---|
| 2,863,303 | A | | 12/1958 | Wurtz | |
| 3,452,183 | A | * | 6/1969 | Burger | H05B 3/50 219/406 |
| 4,485,643 | A | * | 12/1984 | Kato | F25B 39/022 165/174 |
| 4,535,600 | A | | 8/1985 | Gelbard | |
| 4,766,736 | A | * | 8/1988 | Waldschmidt | F16B 2/241 62/275 |
| 2002/0184904 | A1 | * | 12/2002 | Wellman | F25D 21/12 62/186 |

FOREIGN PATENT DOCUMENTS

| | | | | |
|---|---|---|---|---|
| KR | 200170050 | | 7/1997 | |
| KR | 100246378 | | 4/2000 | |
| KR | 2020000011252 | * | 6/2000 | F25D 21/00 |
| KR | 100593630 | | 6/2006 | |
| KR | 100848867 | | 7/2008 | |
| KR | 1020080109146 | | 12/2008 | |

OTHER PUBLICATIONS

International Search Report in International Application No. PCT/KR2017/002269, dated May 30, 2017, 4 pages.

* cited by examiner

EVAPORATOR AND REFRIGERATOR COMPRISING SAME

CROSS-REFERENCE TO RELATED APPLICATIONS

This application is a National Stage application under 35 U.S.C. § 371 of International Application No. PCT/KR2017/002269, filed on Mar. 2, 2017, which claims the benefit of Korean Application No. 10-2016-0034187, filed on Mar. 22, 2016. The disclosures of the prior applications are incorporated by reference in their entirety.

BACKGROUND OF THE INVENTION

1. Field of the Invention

The present disclosure relates to an evaporator having a defrosting device for removing frost, and a refrigerator having the same.

2. Description of the Related Art

The refrigerator is a device for keeping food stored in the refrigerator at low temperatures using cold air generated by a refrigerating cycle in which a process of compression, condensation, expansion, and evaporation is continuously performed.

A refrigerating cycle in a refrigerating chamber (or a refrigerating compartment) includes a compressor compressing a refrigerant, a condenser condensing the refrigerant in a high-temperature and high-pressure state compressed by the compressor through heat dissipation, and an evaporator cooling ambient air according to a cooling operation of absorbing ambient latent heat as the refrigerant provided from the condenser is evaporated. A capillary or an expansion valve is provided between the condenser and the evaporator to increase a flow rate of the refrigerant and lower pressure so that the refrigerant flowing to the evaporator may easily be evaporated.

A cooling method of the refrigerator may be divided into an indirect cooling method and a direct cooling method.

The indirect cooling method is a method of cooling the inside of a storage chamber by forcibly circulating cold air generated by the evaporator using a blow fan. Generally, the indirect cooling method is applied to a structure in which a cooler chamber in which an evaporator is installed and a storage chamber in which food is stored are separated from each other.

The direct cooling method is a method in which the inside of a storage chamber is cooled by natural convection of cold air generated by an evaporator. The direct cooling method is largely applied to a structure in which an evaporator is formed in an empty box form to form a storage chamber in which food is stored.

Generally, a direct cooling type refrigerator employs a roll-bond type evaporator in which two case sheets with a pattern part interposed therebetween are pressure-welded, high pressure air is blown into the compressed pattern part to discharge the pattern part, and a portion where the pattern part was present is expanded to form a cooling channel in which a refrigerant flows between the two pressure-welded case sheets.

Meanwhile, a difference in relative humidity between a surface of the evaporator and ambient air may cause moisture to be condensed to develop to frost on the surface of the evaporator. The frost deposited on the surface of the evaporator acts as a factor to degrade heat exchange efficiency of the evaporator.

In the case of an indirect cooling type refrigerator, a defrost heater is installed in an evaporator to remove frost deposited on the evaporator. The defrost heater is driven (turned on/off) according to predetermined conditions to generate heat to melt and remove frost deposited on the evaporator.

However, a direct cooling type refrigerator having the structure in which a defrost heater is applied to an evaporator has not yet been proposed. Therefore, in the case of the direct cooling type refrigerator, in order to remove frost, natural defrosting must be performed for a predetermined period of time after forcibly turning off a compressor, causing inconvenience, and it is difficult to ensure freshness of food due to the long defrosting time.

SUMMARY OF THE INVENTION

A first object of the detailed description is to provide an evaporator having a new structure in which a sheath heater is applied to a roll-bond type evaporator case applied to a direct cooling type refrigerator.

A second object of the detailed description is to provide an evaporator including a sheath heater which may use an existing a roll-bond type evaporator case as is.

A third object of the detailed description is to provide a structure in which heat generated by a sheath heater is effectively used for removing frost deposited on an evaporator and transfer of heat generated by the sheath heater to a refrigerating chamber is prevented.

To achieve the first object, a refrigerator includes: a cabinet including a freezing chamber and a refrigerating chamber provided above and below; and an evaporator installed in the freezing chamber, wherein the evaporator includes: an evaporator case having a box shape with both sides thereof opened and forming a storage space for food therein; a cooling tube formed in a predetermined pattern on the evaporator case and filled with a refrigerant for cooling therein; and a sheath heater disposed to be adjacent to at least one surface of the evaporator case on an outer side of the evaporator case and generating heat when power is applied thereto such that heat for defrosting is transferred to the evaporator case.

The second object of the present disclosure may be achieved by installing a sheath heater to be adjacent to an existing roll-bond type evaporator case equipped with a cooling flow channel.

The third object of the present disclosure may be achieved by a reflective member and an insulating member.

The reflective member may be disposed to face the evaporator case with the sheath heater interposed therebetween and reflect heat generated by the sheath heater.

The reflective member may be formed of aluminum.

The reflective member may be disposed between the sheath heater and the refrigerating chamber.

The reflective member may be attached to a bottom surface of the freezing chamber.

The insulating member may be disposed on a rear surface of the reflective member to prevent heat generated for defrosting from being introduced to the refrigerating chamber.

Meanwhile, the above-described refrigerator may be configured as follows.

The evaporator case may include a fixing member allowing the sheath heater to be caught therein and fixed to a predetermined position.

The fixing member may protrude from the evaporator case to surround the sheath heater together with the evaporator case, and the sheath heater may be supported by the fixing member and spaced apart from the evaporator case at a predetermined distance.

The fixing member may include: a bent portion formed as a portion of the evaporator case is cut and bent outwards; and a recess portion recessed inwards from the bent portion to prepare a space for receiving the sheath heater.

The sheath heater may include: a metal tube disposed to be adjacent to at least one surface of the evaporator case; an electric heating wire installed in the metal tube and generating heat when power is applied; and an insulating material filling an empty space where the electric heating wire is not disposed in the metal tube to insulate the metal tube from the electric heating wire.

Also, the present invention provides a refrigerator including a cabinet having a freezing chamber; and an evaporator installed in the freezing chamber, wherein the evaporator includes: an evaporator case formed by bending two coupled case sheets and having a quadrangular box shape in which a lower surface portion, side surface portions, and an upper surface portion are provided and both sides thereof are open; a cooling tube left as an empty space between the two case sheets and forming a cooling flow channel in which a refrigerant flows; and a sheath heater disposed to be spaced apart from the lower surface portion outwards at a predetermined distance and generating heat when power is applied such that heat for defrosting is transferred to the evaporator case.

The effects of the present disclosure obtained through the above-mentioned solution are as follows.

First, the sheath heater is disposed to be adjacent to at least one surface of the evaporator case on an outer side of the evaporator case and is driven (turned on/off) according to predetermined conditions to generate heat. Heat generated by the sheath heater is transferred to the evaporator case to melt frost deposited on the evaporator case. In this manner, according to the present disclosure, since a defrost time is reduced compared with the existing natural defrosting, freshness of food may be maintained and cooling efficiency, which is reduced due to frost, may be increased to reduce power consumption.

Second, since the structure of the present invention is realized by mounting the sheath heater adjacent to the existing roll-bond type evaporator case, an already manufactured evaporator case and production facility for manufacturing the evaporator case may be utilized.

Third, since the reflective member is disposed to face the evaporator case with the sheath heater interposed therebetween, although a portion of heat generated by the sheath heater is oriented in a direction opposite to the evaporator case, the heat is reflected by the reflective member and transferred to the evaporator case, and thus, heat generated by the sheath heater may be effectively used.

In addition, since the insulating member is disposed on the rear surface of the reflective member and covers the partition dividing the freezing chamber and the refrigerating chamber, heat generated during defrosting may be prevented from being transferred to the refrigerating chamber.

DETAILED DESCRIPTION OF THE INVENTION

Figure 1:
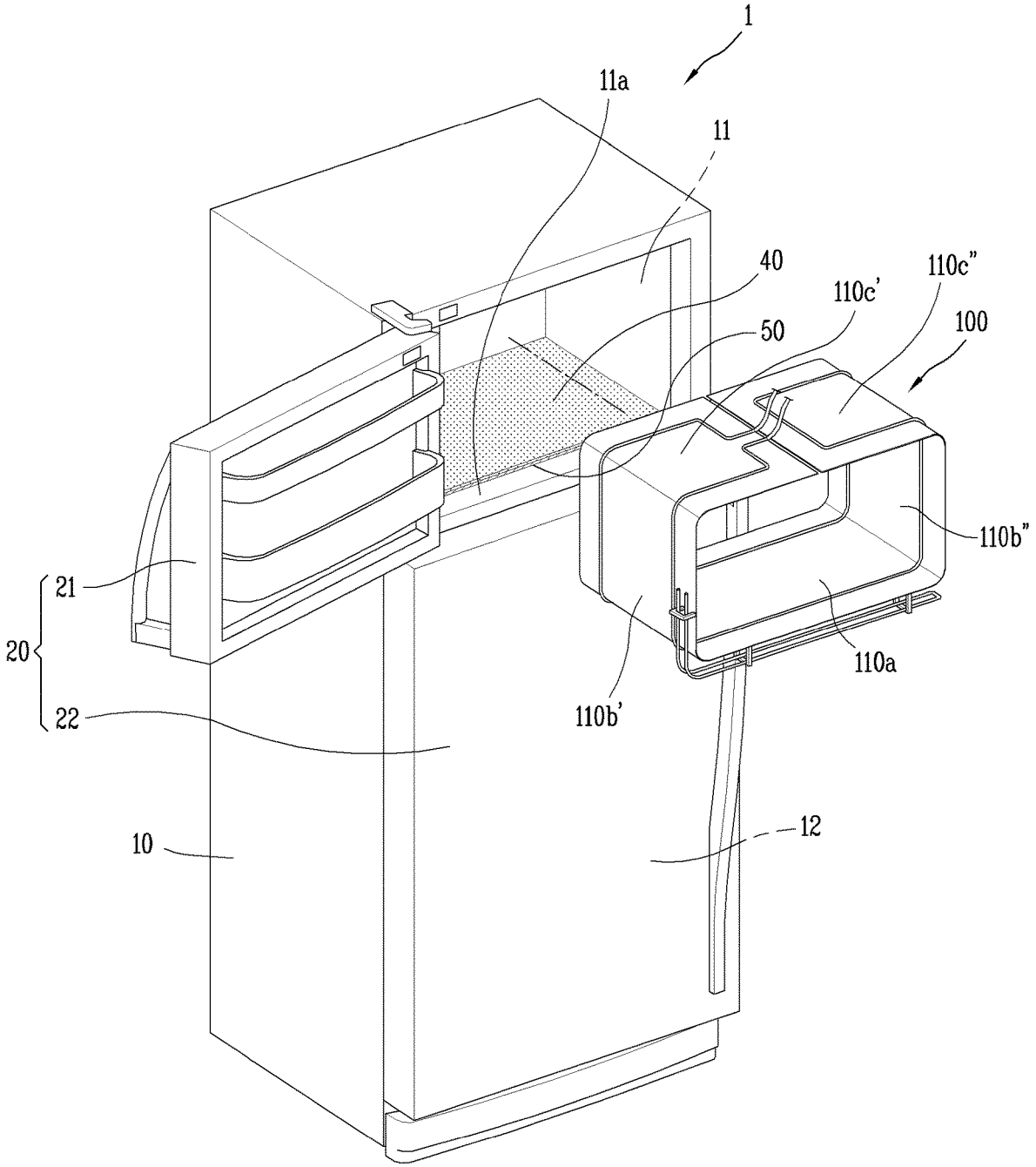
FIG. 1 is a conceptual view illustrating a refrigerator according to an embodiment of the present disclosure.

Hereinafter, an evaporator and a refrigerator having the evaporator according to the present disclosure will be described in detail with reference to the accompanying drawings.

In the present disclosure, the same reference numerals are given to the same or similar components in the different embodiments, and a redundant description thereof will be omitted.

In addition, the structure applied to any one embodiment may be applied in the same manner to another embodiment as long as the different embodiments are not structurally and functionally inconsistent.

As used herein, the singular forms "a", "an" and "the" are intended to include the plural forms as well, unless the context clearly indicates otherwise.

In the following description, when the detailed description of the relevant known function or configuration is determined to unnecessarily obscure the important point of the present disclosure, the detailed description will be omitted.

The accompanying drawings of the present disclosure aim to facilitate understanding of the present disclosure and should not be construed as limited to the accompanying drawings. Also, the present disclosure is not limited to a specific disclosed form, but includes all modifications, equivalents, and substitutions without departing from the scope and spirit of the present disclosure.

FIG. 1 is a conceptual view illustrating a refrigerator 1 according to an embodiment of the present disclosure.

The refrigerator 1 is a device for keeping food stored therein at low temperatures using cold air generated by a refrigerating cycle in which a process of compression, condensation, expansion, and evaporation is continuously performed.

As illustrated, a cabinet 10 has a storage space for storing food therein. The storage space may be separated by a partition wall and may be divided into a freezing chamber (or a freezing compartment) 11 and a refrigerating chamber (or a refrigerating compartment) 12 according to set temperatures.

In the present embodiment, a top mount type refrigerator in which the freezing chamber 11 is disposed on the refrigerating chamber 12 is illustrated, but the present disclosure is not limited thereto. The present disclosure is also applicable to a side-by-side type refrigerator in which a freezing chamber and a refrigerating chamber are disposed on the left and right, and a bottom freezer type refrigerator in which a refrigerating chamber is provided at an upper portion thereof and a freezing chamber is provided at a lower portion thereof.

A door 20 is connected to the cabinet 10 to open and close a front opening of the cabinet 10. In the figure, a freezing chamber door 21 and a refrigerating chamber door 22 are configured to open and close the front openings of the freezing chamber 11 and the refrigerating chamber 12, respectively. The door 20 may be variously configured as a rotatable door rotatably connected to the cabinet 10, a drawer-type door slidably connected to the cabinet 10, and the like.

A machine chamber (not shown) is provided in the cabinet 10, and a compressor, a condenser, and the like, are provided in the machine chamber. The compressor and the condenser are connected to the evaporator 100 to constitute a refrigerating cycle.

Meanwhile, a refrigerant R circulating in the refrigerating cycle absorbs ambient heat in the evaporator 100 as evaporation heat, thereby obtaining a cooling effect in the periphery. In this process, when a temperature difference with ambient air occurs, moisture in the air is condensed and frozen on the surface of the evaporator 100, that is, frost is deposited thereon. Frost deposited on the surface of the evaporator 100 acts as a factor to lower the heat exchange efficiency of the evaporator 100.

In the case of an indirect cooling type refrigerator, a structure in which a defrost heater is installed in an evaporator to remove frost deposited on the evaporator has already been well known. However, in the case of the direct cooling type refrigerator 1 as illustrated in the illustrated embodiment, the structure in which a defrost heater is applied to the evaporator 100 has not yet been proposed.

Thus, a new type evaporator 100 employing a defrost heater to reduce power consumption during defrosting in the direct cooling type refrigerator 1 according to the present disclosure will be described.

Figure 2:
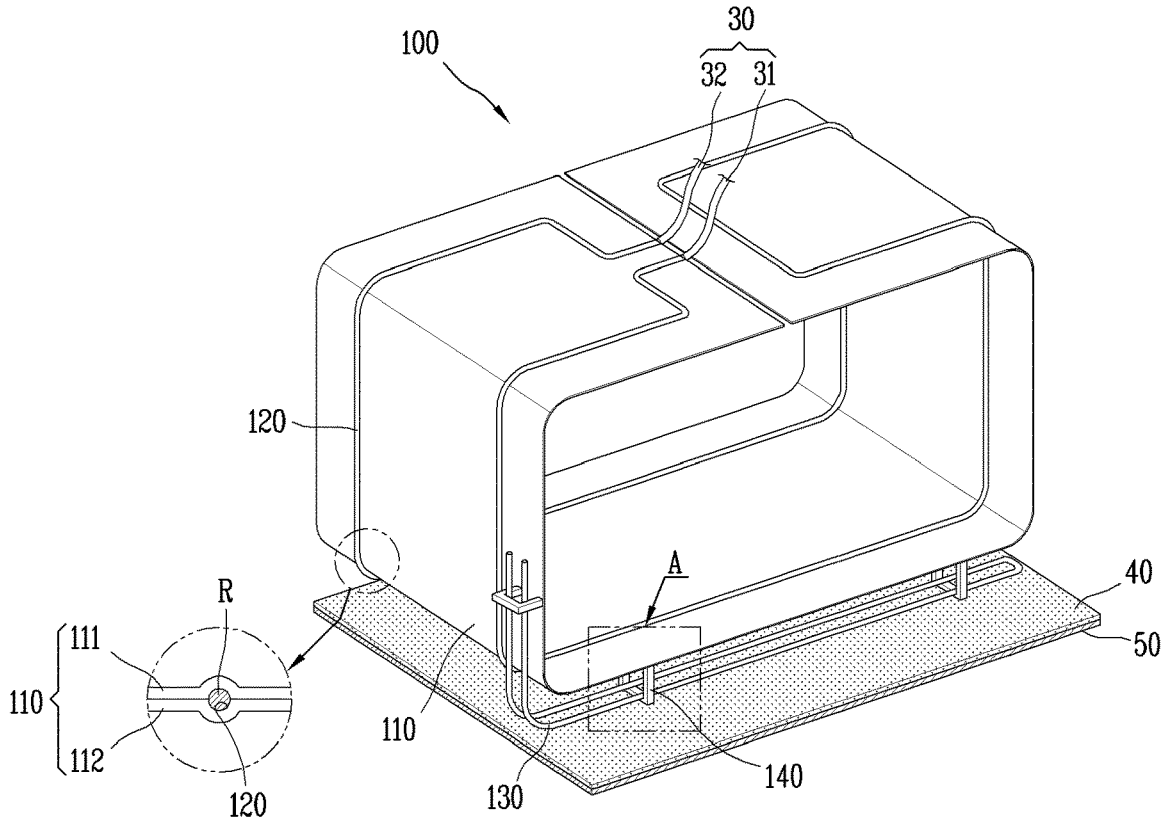
FIG. 2 is a conceptual view illustrating a first embodiment of an evaporator applied to the refrigerator of FIG. 1 and components related to defrosting of the evaporator.
Figure 3:
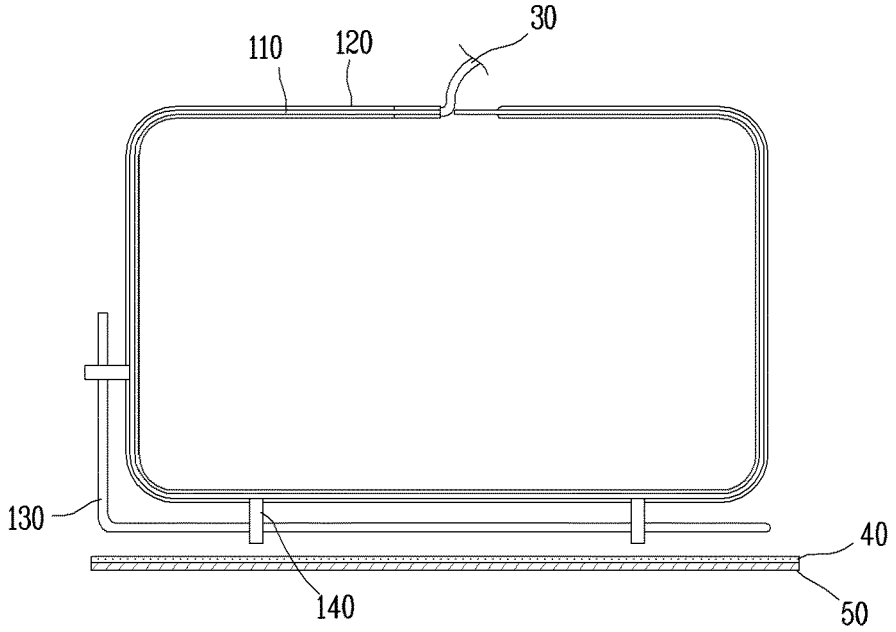
FIG. 3 is a front view of the evaporator illustrated in FIG. 2 and components related to defrosting of the evaporator.

FIG. 2 is a conceptual view illustrating a first embodiment of the evaporator 100 applied to the refrigerator of FIG. 1 and components related to defrosting of the evaporator, and FIG. 3 is a front view of the evaporator 100 illustrated in FIG. 2 and components related to defrosting of the evaporator 100.

Referring to FIGS. 2 and 3, the evaporator 100 of the present disclosure includes an evaporator case 110, a cooling tube 120, and a sheath heater 130. Among the components of the evaporator 100, the cooling tube 120 is a component for cooling, and the sheath heater 130 is a component for defrosting. For reference, the cooling tube 120 and the sheath heater 130 are illustrated briefly for convenience of explanation, and in actuality, these components may have various forms.

The evaporator case 110 is formed in an empty box shape and forms a storage space for food therein. The evaporator case 110 itself may form a storage space for food therein or may be configured to enclose a housing (not shown) separately provided to form a storage space for food.

The cooling tube 120 through which a refrigerant R for cooling flows is formed in the evaporator case 110. The cooling tube 120 is embedded in at least one surface of the evaporator case 110 to form a cooling flow channel through which the refrigerant R may flow.

A method of manufacturing the evaporator case 110 in which the cooling tube 120 is formed will now be described.

First, a first case sheet 111 and a second case sheet 112, which are materials of the evaporator case 110, are prepared. The first and second case sheets 111 and 112 may be formed of a metal (e.g., aluminum, steel, etc.) and a coating layer may be formed on the surfaces of the first and second case sheets 111 and 112 to prevent corrosion due to contact with moisture.

Thereafter, a pattern portion corresponding to the cooling tube 120 is disposed on the first case sheet 111. The pattern portion, which is to be removed later, may be a graphite material disposed in a predetermined pattern.

The pattern portion may be formed so as to continuously extend without a broken portion and may be bent in at least at one portion. The pattern portion may extend from a first corner of the first case sheet 111 to a second corner. The first corner at which the pattern portion starts and the second corner at which the pattern portion terminates may be the same corner or may be different corners.

Next, the first and second case sheets 111 and 112 are brought into contact with each other with the pattern portion interposed therebetween, and then the first and second case sheets 111 and 112 are compressed using a roller device so as to be integrated.

Then, a frame having a plate shape in which the first and second case sheets 111 and 112 are integrated is formed, and the pattern portion is located in the plate-shaped frame. In this state, high-pressure air is injected into the pattern portion exposed to the outside through one side of the frame corresponding to the first corner.

The pattern portion existing between the first and second case sheets 111 and 112 is discharged from the frame by the jetted high-pressure air. In this process, the space in which the pattern unit was present is left as an empty space to form the cooling tube 120.

In the process of discharging the pattern portion by injecting the high-pressure air, the portion where the pattern portion was present may expand, relative to the volume of the pattern portion, to form a cooling flow channel allowing the refrigerant R to flow therein.

According to the manufacturing method, a cooling tube 120 protruding from at least one surface is formed on the frame. For example, when the first and second case sheets 111 and 112 have the same rigidity, the cooling tube 120 protrudes from both sides of the frame. In another example, when the first case sheet 111 has a higher rigidity than the second case sheet 112, the cooling tube 120 protrudes from the second case sheet 112 having a relatively low rigidity and the first case sheet 111 having a relatively high rigidity is kept flat.

The integrated plate-shaped frame is bent to form the evaporator case 110 in the form of an empty box as illustrated. For example, referring to FIG. 1 together, the evaporator case 110 may have a lower surface portion 110*a*, a left side surface portion 110*b*' and a right side surface portion 110*b*" extending to opposing sides from the lower surface portion 110*a*, and a left upper surface portion 110*c*' and a right upper surface portion 110*c*" extending from the left side surface portion 110*b*' and the right side surface portion 110*b*" so as to be parallel with the lower surface portion 110*a*, thus forming a quadrangular box shape with opposing sides opened.

The cooling tube 120 formed in the evaporator case 110 is connected to the condenser and the compressor described above through a cooling pipe 30 and the refrigerating cycle is formed by the connection. The cooling pipe 30 may be connected to the cooling tube 120 by welding.

In detail, one end (inlet) of the cooling tube 120 is connected to one end 31 of the cooling pipe 30 and the other end (outlet) of the cooling tube 120 is connected to the other end 32 of the cooling pipe 30 to form a circulation loop of the refrigerant R. A low-temperature and low-pressure liquid refrigerant R is introduced through one end of the cooling tube 120, and a gaseous refrigerant R flows out through the other end of the cooling tube 120.

According to the structure, the cooling tube 120 is filled with the refrigerant R for cooling, and the evaporator case 110 and air around the evaporator case 110 are cooled according to circulation of the refrigerant R.

Since the evaporator 100 having the foregoing structure is formed such that the bond type cooling tube 120 is embedded in the evaporator case 110, the evaporator 100 has relatively high heat exchange efficiency, as compared with a structure in which the cooling pipe 30 is installed as a separate component to surround the evaporator case 110. In addition, the storage space for food may be increased due to simplification of the cooling channel structure in which the refrigerant R flows.

The sheath heater 130 for defrosting is disposed to be adjacent on an outer side of the evaporator case 110. The sheath heater 130 is configured to generate heat when power is applied thereto according to predetermined conditions. The predetermined conditions may be, for example, a case where a temperature sensed by a temperature sensor (not shown) is lower than a set temperature, a case where humidity sensed by a humidity sensor (not shown) is higher than a set humidity, and the like.

The sheath heater 130 may be disposed adjacent to at least one of the outer surfaces of the evaporator case 110. The sheath heater 130 may be elongated and may be bent from at least a point so as to be changed in an extending direction.

In the present embodiment, the sheath heater 130 is disposed to be spaced apart from the left side surface portion 110*b*' and the lower surface portion 110*a* of the evaporator case 110 at a predetermined distance outwards. Specifically, the sheath heater 130, in a state of being disposed to be adjacent to the left side surface portion 110*b*', extends downwards, is bent beneath the lower surface portion 110*a*, extends rightwards, is bent, and extends in parallel in the opposite direction so as to be returned. According to this configuration, as illustrated in FIG. 3, the sheath heater 130 may have an 'L' shape when the evaporator 100 is viewed from the front.

Heat generated in the sheath heater 130 is transferred to the left side surface portion 110*b*' and the lower surface portion 110*a* of the evaporator case 110 and frost deposited on the evaporator case 110 may be melted to be removed by the heat transferred to the evaporator case 110.

Meanwhile, a portion of the sheath heater 130 disposed adjacent to the left side surface portion 110*b*' of the evaporator case 110 is a portion for line connection with a power supply unit (not shown) and may be configured to be relatively short. Therefore, in this case, main heat transfer may occur in a portion disposed adjacent to the lower surface portion 110*a* of the evaporator case 110. This may be a reasonable arrangement for realizing efficient heat transfer when the characteristics that heat generated by the sheath heater 130 rises due to convection.

The portion of the sheath heater 130 disposed below the lower surface portion 110*a* of the evaporator case 110 may extend to below the right side surface portion 110*b*' of the evaporator case 110. According to this, the bent portion of the sheath heater 130 is positioned below the right side surface portion 110*b*' of the evaporator case 110.

For reference, in this embodiment, it is illustrated that the sheath heater 130 is disposed adjacent to the front side lower surface 110*a* of the evaporator case 110 so that the overall shape of the sheath heater 130 can be seen, but the arrangement of the sheath heater 130 is not limited thereto. The sheath heater 130 may be disposed adjacent to the rear side lower surface portion 110*a* of the evaporator case 110 or may be disposed to be adjacent to a central side lower portion 110*a* of the evaporator case 110 in order to efficiently transfer heat to the entire area of the evaporator case 110.

Unlike the present embodiment, the sheath heater 130 may be configured to surround the outer surface of the evaporator case 110. In this case, the sheath heater 130 is spaced apart from the surface portions (the lower surface portion 110*c*', the side surface portions 110*b*' and 110*b*', and the upper surface portions 110*c*' and 110*c*') forming the evaporator case 110, and here, the sheath heater 130 may be bent to correspond to the bent portion of the evaporator case 110. In this case, when the evaporator 100 is viewed from the front, the sheath heater 130 may have a "▭" shape.

In addition, the sheath heater 130 may be disposed not to overlap the cooling tube 120 to prevent direct heat transfer to the refrigerant R filling the cooling tube 120.

As described above, the sheath heater 130 is disposed adjacent to at least one surface of the evaporator case 110 outside the evaporator case 110, and is driven (turned on/off) according to predetermined conditions to generate heat. Heat generated in the sheath heater 130 is transferred to the evaporator case 110 to melt and remove frost deposited on in the evaporator case 110. As described above, according to the present invention, a defrost time is reduced compared with existing natural defrosting, and thus, freshness of food may be maintained, and cooling efficiency, which is reduced due to frost, may be increased to reduce power consumption.

According to the present invention, since the structure of the present invention is realized by mounting the sheath heater 130 adjacent to the existing roll-bond type evaporator case, already manufactured evaporator cases and the production facility for manufacturing the evaporator cases may be utilized.

Meanwhile, most of the heat generated in the sheath heater 130 is transferred to the adjacent evaporator case 110 to remove frost deposited on the evaporator case 110, but a portion of the heat may be transferred in a direction opposite to that in the foregoing case. This is a kind of heat loss and acts as a factor for lowering defrost efficiency of the sheath heater 130. In addition, transfer of heat generated during defrosting including a portion of the heat to the refrigerating chamber 12 adjacent to the freezing chamber 11 may affect cooling performance of the refrigerating chamber 12.

Hereinafter, a structure for effectively using heat generated in the sheath heater 130 to remove frost deposited on the evaporator 100 preventing heat generated in the sheath heater 130 from being transferred to the refrigerating chamber 12 will be described.

Referring to FIGS. 2 and 3 together with FIG. 1, a reflective member 40 is disposed to face the evaporator case 110 with the sheath heater 130 interposed therebetween, to reflect heat generated in the sheath heater 130. That is, heat generated in the sheath heater 130 and transferred in a direction opposite to a direction toward the evaporator case 110 is mostly reflected by the reflective member 40 so as to be oriented toward the evaporator case 110.

The reflective member 40 may be disposed to be spaced apart from the sheath heater 130 by a predetermined distance. In this embodiment, the reflective member 40 is disposed below the sheath heater 130 located below the lower surface portion 110*a* of the evaporator case 110.

Alternatively, the reflective member 40 may be disposed between the sheath heater 130 and the refrigerating chamber 12. For example, as illustrated, when the refrigerating chamber 12 is positioned below the freezing chamber 11 and the sheath heater 130 is positioned below the evaporator case 110, the reflective member 40 may be positioned below the sheath heater 130 and above the refrigerating chamber 12. In this case, heat generated in the sheath heater 130 and transferred in the direction opposite to the direction toward the evaporator case 110 may be mostly reflected by the reflective member 40, and thus, heat transfer to the refrigerating chamber 12 may be reduced.

In order to realize the structure, as illustrated in FIG. 1, the reflective member 40 may be mounted on a bottom surface of the freezing chamber 11 in order to implement the above structure. Alternatively, the reflective member 40 may be mounted on a separate mounting structure located on the bottom surface of the freezing chamber 11.

However, the mounting structure of the reflective member 40 is not limited thereto. The reflective member 40 may be mounted on the evaporator 100, and the evaporator case 110 equipped with the cooling tube 120, the sheath heater 130, and the reflective member 40 are modularized. To this end, a bracket (not shown) for fixing the reflective member 40 to the evaporator 100 may be provided. Alternatively, the reflective member 40 may be mounted on a connection portion 142 of the fixing member 140, which will be described later.

The reflective member 40 may also be provided on the left side of the sheath heater 130 located on the left side of the left side surface 110*b*' of the evaporator case 110. In this case, the reflective member 40 may be bent to have an 'L' shape to cover the lower surface portion 110*a* and the left side surface portion 110*b*' of the evaporator case 110 with the sheath heater 130 interposed therebetween.

The reflective member 40 may be formed of a metal (e.g., aluminum) having a high heat to reflect heat transmitted from the sheath heater 130. The reflective member 40 may be formed of a metal plate or a film including the metal.

A heat insulating member 50 may be disposed on a rear surface of the reflective member 40. The heat insulating member 50 is configured to block heat generated during a defrosting operation from flowing to the refrigerating chamber 12. The heat insulating member 50 may be attached to the rear surface of the reflective member 40 as illustrated or may be provided separately from the reflective member 40.

As described above, the reflective member 40 is arranged to face the evaporator case 110 with the sheath heater 130 interposed therebetween, and thus, although a portion of heat generated by the sheath heater 130 is oriented in a direction opposite to the evaporator case 110, the heat may be reflected by the reflective member 40 so as to be transferred to the evaporator case 110, whereby heat generated by the sheath heater 130 may be effectively used.

In addition, since the heat insulating member 50 is disposed on the rear surface of the reflective member 40 to cover a partition partitioning the freezing chamber 11 and the refrigerating chamber 12, heat generated during defrosting is prevented from being transferred to the refrigerating chamber 12.

Hereinafter, the structure in which the sheath heater 130 is installed in the evaporator case 110 will be described in more detail.

Figure 4:
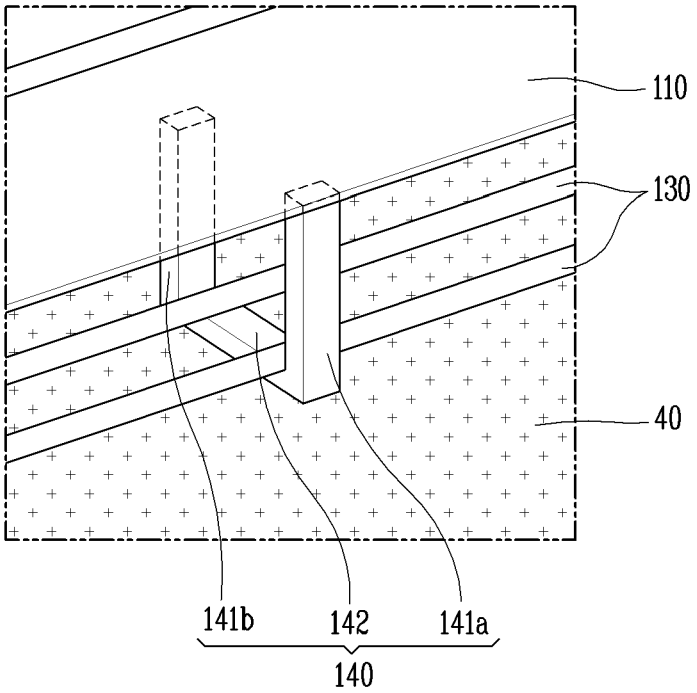
FIG. 4 is an enlarged view of a portion 'A' of FIG. 2.

FIG. 4 is an enlarged view of a portion 'A' illustrated in FIG. 2.

Referring to FIG. 4, a fixing member 140 is provided in the evaporator case 110 so that the sheath heater 130 may be caught and fixed at a predetermined position. The fixing member 140 may be provided in plurality and the plurality of fixing members 140 may be spaced apart from each other by a predetermined distance.

The fixing member 140 of this embodiment is formed of a metal and is coupled to the evaporator case 110 by welding. Referring to FIG. 2, a plurality of fixing members 140 are provided on the lower surface portion 110*a* of the evaporator case 110 at predetermined intervals. The fixing member 140 may further be provided on the left side surface portion 110*b*' of the evaporator case 110.

The fixing member 140 includes a first protrusion 141*a*, a second protrusion 141*b* and a connection portion 142 and support the sheath heater 130.

The first and second protrusions 141*a* and 141*b* protrude to both sides of the sheath heater 130 from the evaporator case 110, and the connection portion 142 connects the first and second protrusions 141*a* and 141*b* and is disposed to cover the outside of the sheath heater 130.

According to the above-described configuration, the fixing member 140 has a "⊏" shape and surrounds the sheath heater 130 together with the evaporator case 110. Accordingly, the sheath heater 130 may be supported by the fixing member 140 and may be spaced apart from the evaporator case 110 at a predetermined distance.

Hereinafter, a detailed structure of the sheath heater 130 will be described.

Figure 5:
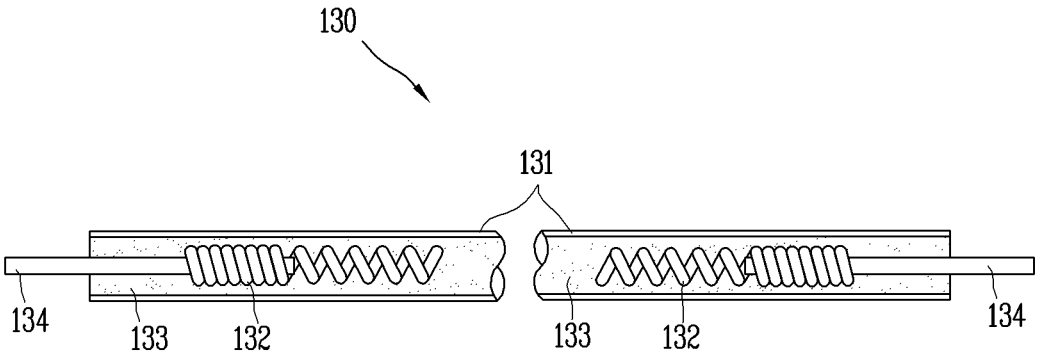
FIG. 5 is a conceptual view illustrating a detailed structure of a sheath heater illustrated in FIG. 2.

FIG. 5 is a conceptual view illustrating a detailed structure of the sheath heater 130 illustrated in FIG. 2.

Referring to FIG. 5, the sheath heater 130 includes a metal tube 131, an electric heating wire 132, and an insulating material 133.

The metal tube 131, a part forming an appearance of the sheath heater 130, is disposed adjacent to at least one of the outer surfaces of the evaporator case 110. The metal tube 131 may extend along at least one surface of the evaporator case 110. The metal tube 131 may be formed of stainless steel, aluminum, or the like.

The electric heating wire 132 is inserted into the metal tube 131 to generate heat when power is applied. A nickel-chromium-based electric heating wire may be used as the electric heating wire 132.

The electric heating wire 132 may extend along the metal tube 131. In this embodiment, the electric heating wire 132 extends from one end of the metal tube 131 to the other end, and the electric heating wire 132 is densely wound on the metal tube 131 like a coil in order to improve a heating temperature per unit area.

A terminal pin 134 is connected to the electric heating wire 132. The terminal pin 134 extends to the outside of the metal tube 131 and is electrically connected to a power supply unit (not shown). Since the terminal pin 134 is exposed to the outside of the metal tube 131, the terminal pin 134 may come into contact with moisture including defrosting water. In consideration of this, a protective tube (not shown) may be formed to surround the terminal pin 134. The protection tube may be formed of a heat-resistant synthetic resin material (e.g., PVC, or the like).

The insulating material 133 fills an empty space where the electric heating wire 132 is not disposed in the metal tube 131 to insulate the metal tube 131 from the electric heating wire 132. The insulating material 133 may include magnesium oxide or aluminum oxide powder.

For reference, the reason why the heater having the above structure is named as the sheath heater 130 is because the structure in which the metal tube 131 protects the electric heating wire 132 is similar to a sheath protecting a blade.

Hereinafter, other examples of fixing members 240, 250, 313, and 340 will be described.

Figure 6:
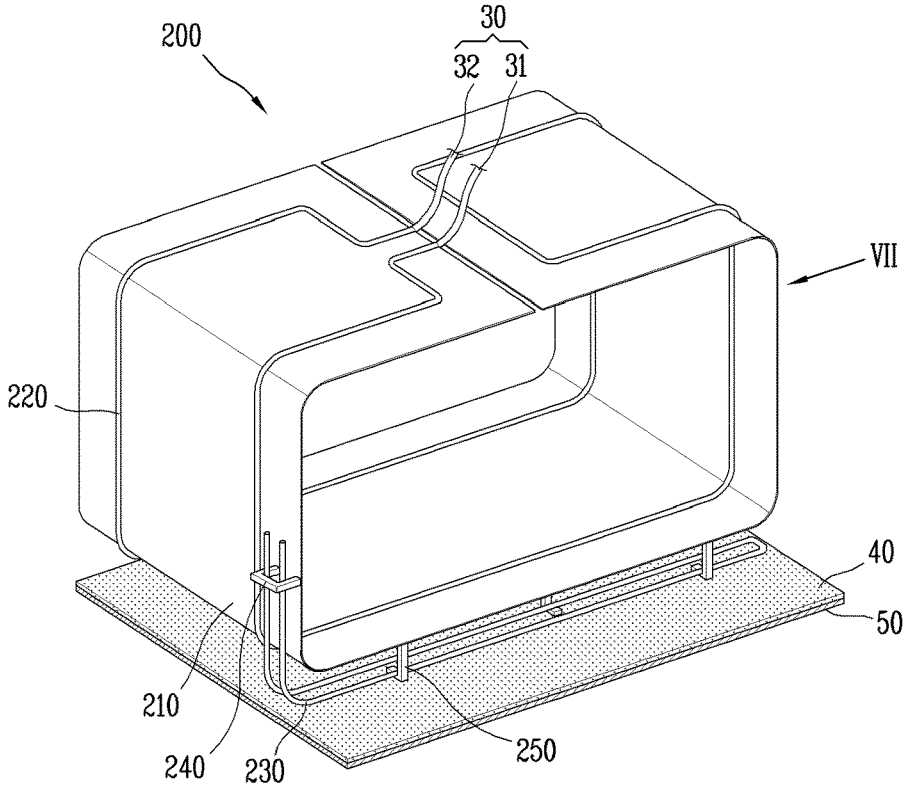
FIG. 6 is a conceptual view illustrating a second embodiment of an evaporator applied to the refrigerator of FIG. 1 and components related to defrosting of the evaporator.
Figure 7:
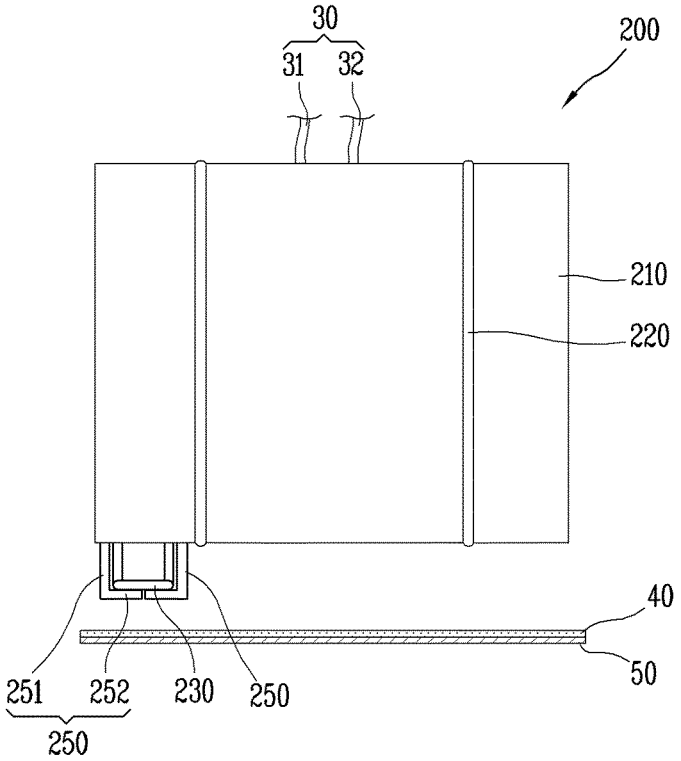
FIG. 7 is a view of the evaporator illustrated in FIG. 6 and components related to defrosting of the evaporator, viewed in a VII direction.

FIG. 6 is a conceptual view illustrating a second embodiment of an evaporator 200 applied to the refrigerator 1 of FIG. 1 and components related to defrosting of the evaporator 200, and FIG. 7 is a view of the evaporator 200 and the components related defrosting of the evaporator 200 illustrated in FIG. 6, viewed in a VII direction.

Referring to FIGS. 6 and 7, a fixing member 250 includes a protrusion 251 protruding to one side of the sheath heater 230 from a lower surface of an evaporator case 210 and an extending portion 252 bent from the protrusion 251 and extending to cover the outside of the sheath heater 230. The fixing member 250 may be formed of a metal and fixed to the evaporator case 210 by welding.

According to the above-described configuration, the fixing member 250 has an 'L' shape and supports the sheath heater 230. The fixing member 250 may be provided in plurality, and the plurality of fixing members 250 may be spaced apart from each other at a predetermined distance and may be alternately disposed on one side and the other side of the sheath heater 230.

Meanwhile, a fixing member 240 having the same '⊏' shape as that of the fixing member 140 of the previous embodiment may be provided on a left side surface portion of the evaporator case 210 to surround the sheath heater 230 together with the evaporator case 210. Alternatively, the fixing member 240 may have the same 'L' shape as that of the fixing member 250 described above.

Figure 8:
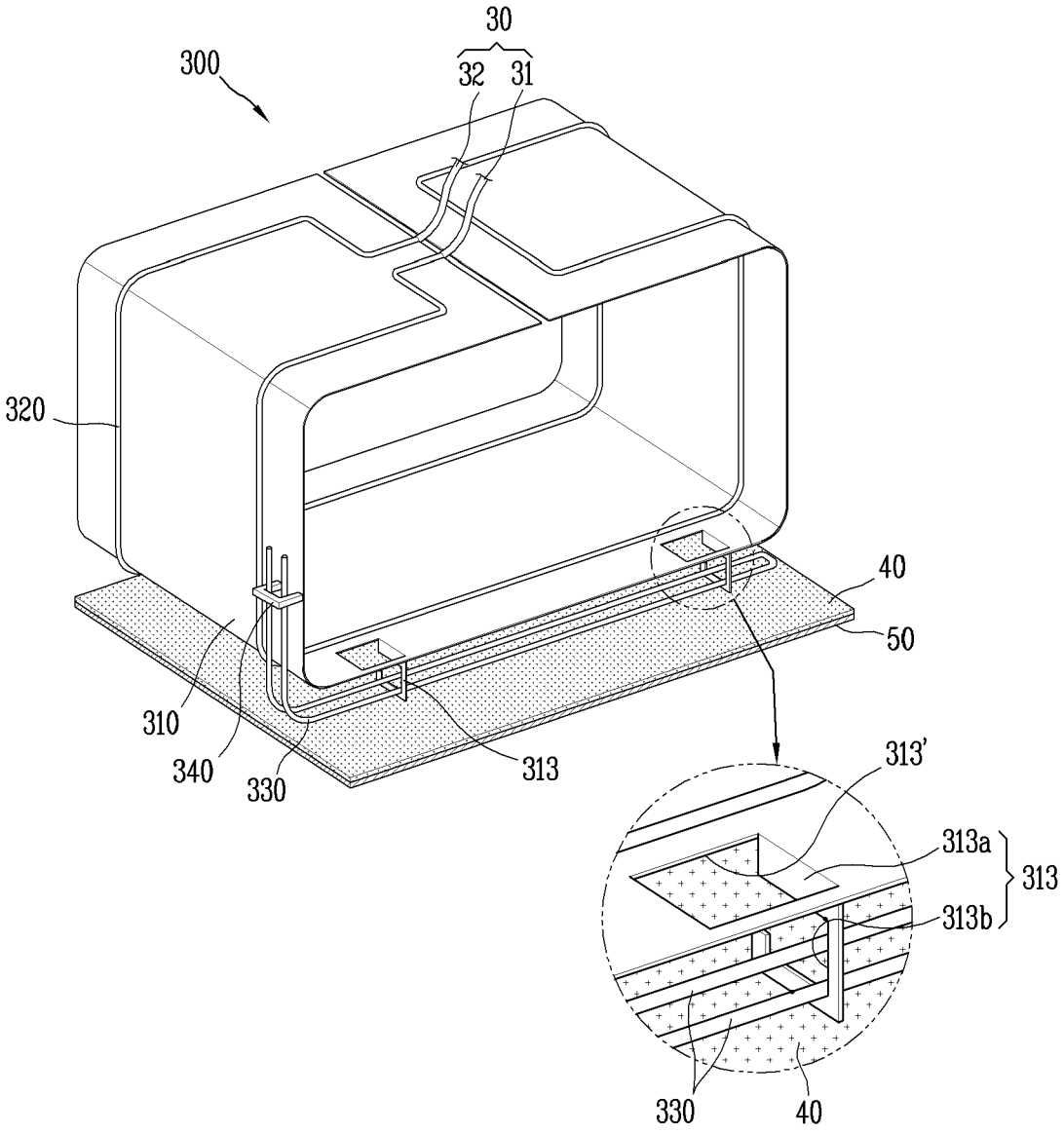
FIG. 8 is a conceptual view illustrating a third embodiment of an evaporator applied to the refrigerator of FIG. 1 and components related to defrosting of the evaporator.

FIG. 8 is a conceptual view illustrating a third embodiment of an evaporator 300 applied to the refrigerator 1 of FIG. 1 and components related to defrosting of the evaporator 300.

As illustrated, the evaporator case 310 may be partially cut and bent to form a fixing member 313. In this figure, a portion of a lower surface portion of an evaporator case 310 is cut and bent to fix the sheath heater 330 to below the lower surface portion.

The fixing member 313 includes a bent portion 313*a* and a recess portion 313*b*.

The bent portion 313*a* corresponds to a portion where the evaporator case 310 is partially cut and bent to the outside, and the recess portion 313*b* corresponds to a recessed space formed in the bent portion 313*a* to receive the sheath heater 330.

According to this structure, the sheath heater 330 may be received and supported in the recess portion 313*b* and fixed at a predetermined distance from the evaporator case 310. The fixing member 313 may be provided at a plurality of locations along at least one surface of the evaporator case 310 corresponding to an extending direction of the sheath heater 330.

Meanwhile, a fixing member 340 having the same '⊏' shape as that of the fixing member 140 of the previous embodiment may be provided on a left side surface portion of the evaporator case 310 to surround the sheath heater 330 together with the evaporator case 310. Alternatively, the fixing member 340 may have the same shape as the fixing member 313 by cutting a portion of the left side surface portion of the evaporator case 310 described above.

What is claimed is:

1. A refrigerator comprising:

a cabinet including a freezing chamber and a refrigerating chamber; and an evaporator installed in the freezing chamber, wherein the evaporator includes:

an evaporator case having a box shape with both sides thereof opened and forming a storage space for food therein;

a cooling tube formed in a predetermined pattern on the evaporator case and filled with a refrigerant for cooling therein; and a sheath heater that is spaced apart from at least one surface of the evaporator case outwards at a predetermined distance and that generates heat based on power being applied thereto such that heat for defrosting is transferred to the evaporator case, wherein the sheath heater and the cooling tube are arranged to be non-overlapping in a thickness direction of the evaporator case, wherein the evaporator case includes a fixing member that is coupled to the sheath heater to fix the sheath heater at a predetermined distance from the evaporator case, and wherein the fixing member protrudes from the evaporator case to surround the sheath heater together with the evaporator case.

2. The refrigerator of claim 1, wherein the at least one surface includes an outer lower surface of the evaporator case.

3. The refrigerator of claim 1, further comprising:

a reflective member disposed to face the evaporator case with the sheath heater interposed therebetween and reflecting heat generated by the sheath heater.

4. The refrigerator of claim 3, wherein the reflective member is formed of aluminum.

5. The refrigerator of claim 3, wherein the reflective member is disposed between the sheath heater and the refrigerating chamber.

6. The refrigerator of claim 5, wherein the reflective member is attached to a bottom surface of the freezing chamber.

7. The refrigerator of claim 5, further comprising:

an insulating member disposed on a rear surface of the reflective member to prevent heat generated for defrosting from being introduced to the refrigerating chamber.

8. The refrigerator of claim 1, wherein the fixing member includes:

a bent portion formed as a portion of the evaporator case is cut and bent outwards; and a recess portion recessed inwards from the bent portion to prepare a space for receiving the sheath heater.

9. The refrigerator of claim 1, wherein the sheath heater includes:

a metal tube disposed to be adjacent to at least one surface of the evaporator case;

an electric heating wire installed in the metal tube and generating heat when power is applied; and an insulating material filling an empty space where the electric heating wire is not disposed in the metal tube to insulate the metal tube from the electric heating wire.

10. A refrigerator comprising:

a cabinet having a freezing chamber; and an evaporator installed in the freezing chamber, wherein the evaporator includes:

an evaporator case having two coupled case sheets and having a quadrangular box shape in which a lower surface portion, side surface portions, and an upper surface portion are provided and both sides thereof are open;

a cooling tube left as an empty space between the two case sheets and forming a cooling flow channel in which a refrigerant flows; and a sheath heater disposed to be spaced apart from the lower surface portion outwards at a predetermined distance and generating heat based on power being applied such that heat for defrosting is transferred to the evaporator case, wherein the sheath heater and the cooling tube are arranged to be non-overlapping in a thickness direction of the evaporator case, wherein the evaporator case includes a fixing member that is coupled to the sheath heater to fix the sheath heater at a predetermined distance from the evaporator case, and wherein the fixing member protrudes from the evaporator case to surround the sheath heater together with the evaporator case.

11. The refrigerator of claim 10, further comprising:

a reflective member disposed to face the evaporator case with the sheath heater interposed therebetween and reflecting heat generated by the sheath heater.

12. The refrigerator of claim 11, further comprising:

an insulating member disposed on a rear surface of the reflective member to prevent heat generated for defrosting from being introduced to a refrigerating chamber positioned on a rear surface of the reflective member.

13. The refrigerator of claim 12, wherein the reflective member is formed of aluminum.

14. The refrigerator of claim 12, wherein the reflective member is disposed between the sheath heater and the refrigerating chamber.

15. The refrigerator of claim 10, wherein the fixing member includes:

a bent portion of the evaporator case that is bent outwards from the evaporator case; and a recess portion recessed inwards from the bent portion to define a space for receiving the sheath heater.

16. The refrigerator of claim 10, wherein the sheath heater includes:

a metal tube disposed to be adjacent to at least one surface of the evaporator case;

an electric heating wire installed in the metal tube and generating heat based on power being applied; and an insulating material filling an empty space where the electric heating wire is not disposed in the metal tube to insulate the metal tube from the electric heating wire.

* * * * *